United States Patent [19]

Gablin et al.

[11] 4,167,491

[45] * Sep. 11, 1979

[54] RADIOACTIVE WASTE DISPOSAL

[75] Inventors: Kenneth A. Gablin, Burton; Larry J. Hansen, Tacoma, both of Wash.

[73] Assignee: Nuclear Engineering Company, Jeffersontown, Ky.

[ * ] Notice: The portion of the term of this patent subsequent to Mar. 1, 1994, has been disclaimed.

[21] Appl. No.: 693,419

[22] Filed: Jun. 7, 1976

Related U.S. Application Data

[60] Division of Ser. No. 420,008, Nov. 29, 1973, Pat. No. 4,010,108, which is a continuation of Ser. No. 220,449, Jan. 24, 1972, abandoned.

[51] Int. Cl.[2] ..... G21F 9/16

[52] U.S. Cl. ..... 252/301.1 W

[58] Field of Search ..... 252/301.1 W; 250/506, 250/507

[56] References Cited

U.S. PATENT DOCUMENTS

| | | | |
|---|---|---|---|
| 3,012,385 | 12/1961 | Hufft | 252/301.1 W |
| 3,330,088 | 7/1967 | Dunlea, Jr. | 252/301.1 W |

FOREIGN PATENT DOCUMENTS

| | | | |
|---|---|---|---|
| 962582 | 7/1964 | United Kingdom | 252/301.1 W |

OTHER PUBLICATIONS

Bonniaud, R. et al., "Etude de la Solidification des Boues Radioactives", Energie Nucleaire, vol. 2, #1, Jan.-Feb. 1960, pp. 22-26.

Skeist, I., Ed., *Handbook of Adhesives* Van Nostrand Reinhold Co., New York, 1965, pp. 310-322 and 601-608.

*Primary Examiner*—Benjamin R. Padgett
*Assistant Examiner*—Deborah L. Kyle
*Attorney, Agent, or Firm*—Schapp and Hatch

[57] ABSTRACT

A method of disposing of wet radioactive waste materials such as those generated in the water used to cool atomic reactors, comprising combining the waste material with a hydrophilic resin in proportions sufficient to provide a solid mass of the resin with the radioactive waste component distributed within. In its preferred form, the waste material is concentrated by separating water from the radioactive portions thereof by methods such as evaporation, taking up the waste components with an ion exchange resin and separating the resin from the bulk of the water, or by the addition of flocculating agents or the like and filtering. The preferred hydrophilic resinous material is a conventional urea-formaldehyde dispersion, which is partially polymerized and capable of taking up water and fully polymerizing upon the addition of an acidic curing agent. The method also contemplates adding a substantially waterproof resinous material to the surface of the solid block, or enclosing it in a waterproof container, or both.

13 Claims, No Drawings

RADIOACTIVE WASTE DISPOSAL

This is a division of application Ser. No. 420,008, filed Nov. 29, 1973, now U.S. Pat. No. 4,010,108 which is a continuation of Ser. No. 220,449, filed Jan. 24, 1972, now abandoned.

BACKGROUND OF THE INVENTION

The present invention relates to improvements in RADIOACTIVE WASTE DISPOSAL, and more particularly to the disposal of radioactive materials by immobilizing them within a solid mass for storage and/or burial.

It is well known that waste products occur as a natural result of activity involving the use of radioactive isotopes. For example, waste products are provided during the operation of atomic reactors and the like, and these waste products may be produced directly from primary radiation sources or secondarily by the creation of isotopes from non-radioactive metals or the like. In order to assure smooth efficient continuation of atomic processes generating such waste material, efficient disposal means must be provided both for primary and secondary waste products.

At the present time, disposal has been achieved by immobilizing the waste in a solid block, and then by disposal at sea or by burial in a specially designated burial site. Burial at sea requires more and more preparation, because of the long range effects of certain pollution components that might build up. When the product is disposed of at a burial site, it is also necessary to provide safe means for transporting the material to the burial site. In addition, it is important to assure the containment and safe storage of the material at the burial site for a time sufficient to allow a sufficient decay of the radioactive components to reduce the radiation intensity thereof to a relatively safe level. Thus it is seen that whatever the disposal of the waste material, it is important to provide means for protecting the material and assuring its safe storage at the disposal site for a long period of time.

Prior to this invention, Portland Cement has been in rather widespread use for the purpose of encapsulating and holding radioactive waste material therewithin so as to provide a protective block for the material at the burial site. Portland cement has been found to be particularly advantageous where the radioactive waste material is present in water, and it is advantageous to dispose of a certain amount of water along with the radioactive waste material in order to provide an efficient handling process.

For example, the water utilized in the cooling loop of atomic reactors tends to accumulate contaminations of radioactive nickel and cobalt probably as a result of conversion of iron and/or nickel in the tubes carrying the water. In any event, these materials build up in the water so that it is important to remove the waste from time to time in order to prevent a buildup from reaching a very hot or hazardous level. In such a case, probably the most serious component is cobalt 60, because it emits hard gamma rays and has a half-life of approximately five years.

Prior to this invention, the cooling water was removed and mixed with Portland Cement in the usual water-cement ratio, allowed to solidify and then the block of cement buried in a waste dump. Such disposal has been generally satisfactory for many operations, but it has a number of disadvantages. One of the disadvantages resides in the heavy weight of the cement and the like, which must be transported often over a considerable distance. Another disadvantage, and perhaps a more serious one, resides in the fact that many waste products of this general class now contain levels of boron material that render disposal in Portland Cement unsatisfactory or impossible because of the lack of compatability of the materials. Other areas of improvement are also seen to be available, such as the handling problems occuring with cement in processing equipment and the possibility of the cement setting up in an undesired fashion during an unexpected shutdown. Rather than go into all of the disadvantages of the cement process, it is proposed to provide an improved process in which certain advantages are achieved, and which is particularly suitable for disposing of waste products having high concentrations of compounds containing boron.

Another problem which has been of some concern with the use of Portland Cement is the possibility of the radioactive material leaching therefrom. This problem is particularly acute where disposal at sea is contemplated, and efforts to utilize materials other than Portland Cement have generally been in the area of the use of hydrophobic materials so as to render the solid block substantially leach-proof. However, the use of hydrophobic materials such as bitumen or asphalt has a number of disadvantages particularly in the mixing and processing steps, and the use of these materials has generally been rejected as not substantially improving the situation involved with the use of Portland Cement.

SUMMARY OF THE INVENTION

From the above background material, it is seen that a primary object of the present invention is to provide a process for making a disposable waste product material in which improvements are made over the use of Portland Cement in order to increase the range of disposable materials, provide reduction of weight required for shipping, and generally provide a more reliable disposal from the standpoint of safety and the like.

These and other objects are achieved by solidifying the wet or water-carried waste product through the steps of adding a hydrophilic resinous material to the waste in an amount sufficient to set up and cure into a solid block, mixing the materials together to provide the desired distribution of waste materials therein, and curing the material to a solid mass.

In general, it is believed that any hydrophilic resinous material capable of taking up water upon curing will be suitable to render the wetted or water-carried waste material immobile and shielded therewithin. However, the preferred hydrophilic resin is any of the usual urea-formaldehyde compositions, which are available commercially in the partially polymerized state, and capable of curing to a high polymer upon the addition of an acidic curing agent. After the radioactive waste material is thus immobilized within a solid block of hydrophilic resinous material, it may be waterproofed to protect against leaching, if desired. This objective may be achieved by the addition of a substantially waterproof resin as a coating thereover, or by a cover or any other protective waterproofing material that will prevent transfer of water from within to the outside and reverse.

Another object of the present invention is to provide improvements within this general process of providing a safe immobilized waste product, and to increase the efficiency of the use of materials and the like used up in the process.

Thus in the preferred form of the invention, the radioactive waste material is first concentrated to a level more suitable for disposal, but still at a sufficiently low level so as to remain within the low hazard classifications. Where the radioactive material is present in water, this concentration is obtained by water removal. In the case of removal of radioactive waste from the water in the cooling loop of a reactor, the removed water may advantageously be returned to usage for further cooling.

In such a case, water containing radioactive ions such as radioactive irons, nickels, and cobalt, are brought in contact with ion exchange resin beads capable of taking up such cations and holding them within the resin mass. The water which is thus deionized and thereby has its radioactive metallic ion component substantially removed is returned to the cooling loop, and the wet resin beads containing the radioactive components are then disposed of by encapsulating them within a hydrophilic resinous material is explained above. In general, any ion exchange resin capable of picking up radioactive waste components may be used. However, where it is desired to remove iron, nickel and cobalt ions, cation exchangers should be used. Cation exchange resins are well known, and available commercially. A typical ion exchange resin preferred in the practice of the process of this invention has a styrene-divinylbenzene matrix which is suitably sulfonated to provide a strongly acidic, cation exchange resin in the form of beads. Such resins are sufficiently dense and insoluble in water to provide easy separation, yet are sufficiently hydrophilic to provide the desired ion exchange activity as well as to provide compatability with the hydrophilic resins utilized in accordance with the present invention.

It will be appreciated that absorbing agents in general, which may or may not be classified as ion exchange resins, but which are capable of picking up the desired radioactive component are also suitable. In this connection, materials such as diatomaceous earth, Powdex (powdered filter aid) Solco Foc (wood cellulose flour) and the like are suitable. In such case, the substances may be filtered out advantageously to provide solids having concentration of wastes therein. When a typical ion exchange resin is used, instead of filtering same, the resin may be regenerated after separation in a more concentrated solution and the regenerated resin beads recycled for reuse. Another method of concentrating the materials is simply by vacuum evaporation of the water, and the water vapor may be condensed and returned again to the process from whence it came, if desired.

While it will be seen that any of these methods for concentrating the waste materials may be suitable in and of themselves, it is also sometimes advantageous to provide a combination of methods so as to provide a controlled concentration of waste and water in proper proportion for mixture with the resin. In addition, filter aids and filtration may be utilized instead of ion exchange beads to concentrate the materials and locate them in certain desired areas within the final solid resinous block. It is also desirable to add filler material or the like to extend the resin and also act as an additional shield for the radioactive components.

In other words, the solids of this invention not only hold and immobilize the waste material, but they provide a primary shield therefor so that the radiation such as hard gamma rays are reduced before leaving the solid mass in which the radioactive sources are contained. It will also be appreciated that any other suitable filler material may be added to the resinous components in accordance with those materials suggested in the literature for use with the particular resin involved. In all such cases, the amount of filler will be determined by conventional standards, i.e. the amount which will best extend and increase the use of the resin itself, but will stay within the ranges of physical properties desired for the final composition.

The use of hydrophilic resins in accordance with the present invention is particularly advantageous with regard to handling of water solutions and wet materials. Such handling not only has the advantage of allowing water to be utilized as a carrier for pumping and other handling and the like, but it also provides the build-in advantages of having water present during the exothermic polymerization reaction. During polymerization, the high heat capacity of the water prevents undue heat built up and provides for proper curing without thermal breakdown. In addition, it provides a convenient method for getting rid of water that may contain waste in and of itself either as a primary carrier, or as a cleaner utilized to flush out radioactive material from the system.

It has also been found that Portland Cement and hydrophilic resinous materials do not hold the water and associated ions in a sufficiently strong bond for certain disposal applications, such as disposal at sea. In such cases, it is contemplated that the solid mass will be further encapsulated in one or more waterproof materials. For example, the solid waste block may be advantageously prepared in a metal container such as a drum and the metal container disposed of along with the resin and waste product. In such a case, however, the metal container may disintegrate or corrode away and expose the resin block too quickly, particularly when subjected to corrosive action of sea water. Accordingly, it is preferred to coat and capsulate or otherwise cover the hydrophilic resin block containing the waste material therein. In other words, a substantially waterproof or water impervious resinous material in the form of a coating or a bag or any other device that will assure containment may be used. If desired, such further material may be carried in a metal container.

For example, the process of this invention may be practiced by utilizing a large metal container such as a drum, lining the container with a polyethylene bag material, with the sides extending sufficiently to provide a fold-over enclosure. With the procedure, the radioactive waste material, resin components, and any other of the materials suggested for use in accordance with the process of this invention are then added, and the resin cured to provide a solid block within the plastic bag and held within the container. The bag is then folded over the top and sealed to provide a waterproof protective coating, and the metal container is then closed. Where such a container is used, leaching of the waste materials will not occur even after the metal container has corroded away.

Alternative to the bag process, it may be advantageous to utilize resins that will adhere to the hydrophilic resin utilized in the primary process. Such processes may be carried out by first curing a base lining in the bottom of the container, then curing the plastic mass within the container, with curing providing a certain amount of shrinkage, and then curing the waterproof or water repellent resin in the further stage around the side and top so as to completely fill the container and provide a water resistant protective layer. For example, when the preferred urea-formaldehyde resin is used for solidifying and retaining the radioactive waste material in accordance with this invention, the water resistant material may be a butylated urea-formaldehyde or a melamine-formaldehyde resin. These resins have improved resistance to a leaching effect of water. Alternatively, a typical hydrophobic resinous material may be utilized instead of, but in the same manner, by using an asphaltic or bituminous material first as a layer on the bottom and then to fill the side and top voids after processing and shrinking.

Further alternatives and advantages of the invention will become apparent as the specification progresses and the new and useful features of the radioactive disposal described herein will be more fully defined in the claims attached hereto.

DESCRIPTION OF THE PREFERRED EMBODIMENTS

The preferred hydrophilic resin to be used in accordance with this invention is any of the urea-formaldehyde resins available from a plurality of commercial sources as standard articles of commerce. These resins are prepared by reacting urea and formaldehyde in mol ratios between about 1:1 and 1:4 respectively, and preferably between 1:1.5 and 1:2.5. For optimum results, the mol ratio is about 1 part urea to about 2 parts formaldehyde. Typically, solid urea and an aqueous solution of formaldehyde are reacted with one another to produce a resin syrup that is in the thermosetting state but capable of being converted to a thermoset state. These resins are available in syrup form, and sometimes available in a spray-dried form, which may be redispersed in water to a desired solids content. Since part of the water will come from the waste material, the urea-formaldehyde should be in a concentrated form with the final ratio of resin solids and water being present in the final dispersion in a ratio of about 2½ to about 5 parts water per part resin by weight and preferably from about three to about 4 parts water per part resin solids.

A typical catalytic material used to convert the urea resin to a thermoset state at ambient temperature is an acidic material having a dissociation constant between about $10^0$ to $10^{-5}$. The amount of catalytic material used will depend upon the strength of the acidic material used and upon the nature of the composition in which it is used. For example, materials like boric acid tend to inhibit the polymerization, and therefore increased catalyst is required to achieve the same cure time. However, generally the amount of acidic catlytic material will be between say about 0.3% and 20% by weight of the resin solids in the mixture. In general, any acid capable of providing a pH below 5 in the dispersion may be utilized, as is well known in the art, and it is preferred to utilize sodium bisulfate, since it is available as a solid and provides an excellent strength acid.

Certain materials such as filter aids, ion exchange resins and materials that act as one of these or both are usually added in order to improve processing and provide the most economical and practical way to eliminate waste. However, any of these materials which are compatible with the urea-formaldehyde are suitable, and considerable latitude is permissible in this area.

In order to illustrate the preferred procedures of the present invention, the following examples are set forth. However, it should be understood that these examples are primarily for the purpose of illustration and any enumeration of detail contained therein should not be construed as a limitation.

EXAMPLE 1

Water from a reactor cooling loop containing radioactive isotopes of the iron family is passed through a conduit packed with 1200 mililiters of resin beads, which beads are composed of a cation exchange resin available commercially (specifically a sulfonated styrene-divinylbenzene polymer). In this way, radioactive cationic materials are removed from the water and collected by the resin beads. The water is allowed to drain from the beads and the wet beads are then placed in a five gallon container. A 2000 ml solution or dispersion of urea-formaldehyde resin is then prepared by adding 1200 ml water to 800 ml of a dispersion containing about 63–66% solids. This diluted dispersion is then added to the wet beads in the container, and the mixture stirred by an electric stirrer at a speed sufficient to keep the resin beads substantially evenly distributed in the mixture. 50 ml of a saturated solution of sodium bisulphate is then added generally with the stirring being continued. After the sodium bisulfate is added and the mixture gels sufficiently to hold the resin beads from sinking by gravity, the stirring is discontinued and the stirring blades disconnected and left in the mixture. The gel is then allowed to set until the cure is complete, whereupon the unit is ready for disposal.

EXAMPLE 2

Water from a reactor cooling loop containing radioactive waste is mixed with 1200 ml of powdered ion exchange filter aid available in the trade as Powdex. The Powdex is then filtered and added to a five gallon container. A 1200 ml solution or dispersion of urea-formaldehyde resin is then prepared by adding 900 ml water to 300 ml of a dispersion containing about 63–66% solids, and the urea-formaldehyde dispersion added to the five gallon container. The mixture is stirred by an electric stirrer, and 150 ml of a saturated solution of sodium bisulfate is added while continuing the stirring. After the solution gels, the stirring is discontinued and the mixture allowed to cure into a solid thermoset mass.

EXAMPLE 3

Water from a reactor cooling loop containing radioactive waste is mixed with 1200 ml diatomaceous earth, and the diatomaceous earth removed by filtration. 1200 ml of urea-formaldehyde dispersion similar to that used in Example 2, and the treated diatomaceous earth is added to a five gallon container. These materials are stirred with an electric stirrer and 100 ml of a saturated solution of sodium sulphate is added. After the solution gels, the stirring is discontinued and the mixture allowed to cure into a solid thermoset mass.

EXAMPLE 4

Water from a reactor cooling loop containing radioactive waste is placed in a vacuum and about 80% of the water removed by vacuum evaporation. 900 ml of the evaporated waste water and 1200 ml of a wood celulose flour is added to a five gallon container. 300 ml of a urea-formaldehyde dispersion containing about 63–65% solids is also added. The ingredients are then stirred with an electric stirrer and 150 ml of saturated sodium bisulfate is added. After the solution gels the stirring is discontinued and the mixture is allowed to cure into a solid thermoset mass.

EXAMPLE 5

The procedure of Example 4 is repeated, except that the evaporated waste water contains borate moities in the amount of about 20% by weight of the solution calculated as boric acid. Similarly good results are obtained.

EXAMPLE 6

Water from a reactor cooling loop containing radioactive waste is flashed in a vacuum to remove about 80% of the water. Another portion of water from the reactor cooling loop is passed through a conduit packed with 1200 ml of ion exchange resin beads similar to those of Example 1. 1200 ml of the evaporated water, the ion exchange resin beads, and 800 ml of a urea-formaldehyde dispersion containing about 63–65% solids are mixed together by an electric stirrer and 50 ml of a saturated solution of sodium bisulphate is added. After the solution gels, the stirring is discontinued and the mixture is allowed to cure into a solid thermoset mass.

The samples obtained from the procedures set forth above are compared with similar samples made with Portland Cement. In all cases, the samples made with the urea-formaldehyde were as good as or better than those made with Portland Cement. Of particular note, is the fact that certain of the cement samples did not set at all. Moreover, contact of the other cement samples with sea water caused them to crack, while the resin samples remained intact under similar circumstances.

From the foregoing description, it is seen that there has been provided an improved method of disposal of radioactive waste material, and particularly an improvement over the process using cement heretofore in major usage.

We claim:

1. An article for safe transportation and storage of radioactive waste material containing free water, comprising a solid body of polymerized urea-formaldehyde resin having water and the radioactive components of such waste material distributed therein in controlled proportions providing a desired low hazard radiation classification of said body.

2. An article as described in claim 1 and wherein said radioactive waste material includes an insoluble ion exchange resin in particulate form.

3. An article as described in claim 1 and wherein said body further comprises a non-radioactive filler material distributed therein for further increasing the volume of said body so as to act as a shield and attenuate radiation levels therefrom.

4. An article as described in claim 1 and wherein said body is encased in a disposable protective container.

5. A composition of matter, comprising an aqueous dispersion of urea-formaldehyde in a partially polymerized state and in an amount sufficient to solidify substantially all of the water present, said aqueous dispersion further including a measured quantity of radioactive waste material and water in a controlled amount to meet a desired low hazard radiation classification of said dispersion, and a curing agent capable of promoting polymerization of said urea-formaldehyde in an amount sufficient to solidify said dispersion, said radioactive waste material being distributed substantially evenly throughout said dispersion.

6. A composition as described in claim 5 and further comprising a measured quantity of particles of ion-exchange resin having radioactive metallic cations adsorbed thereon.

7. A composition as described in claim 6 and wherein said ion-exchange resin comprises a styrene-divinylbenzene matrix suitably sulfonated to provide ~ strongly acidic cation exchange resin.

8. A composition as described in claim 5 and further comprising a measured quantity of particulate insoluble material having radioactive metallic cations absorbed therein.

9. A composition as described in claim 5 and wherein said radioactive waste material comprises nuclear reactor evaporator bottoms.

10. A composition as described in claim 5 and wherein said urea-formaldehyde comprises about 20% to about 40% by weight of the combined weight of said urea-formaldehyde and said water present.

11. A composition as described in claim 10 and wherein said curing agent is an acidic material having a dissociation constant between about $10^0$ and $10^{-5}$.

12. A composition of matter, comprising a solid plastic matrix of cured urea-formaldehyde, a measured quantity of radioactive waste material substantially evenly distributed throughout said matrix, and a controlled quantity of water incorporated in said matrix in an amount to meet a desired low hazard radiation classification.

13. A composition as described in claim 12 and wherein said radioactive waste material is derived from recirculating cooling water in a nuclear reactor.

* * * * *